US005234142A

United States Patent [19]

Loewen et al.

[11] Patent Number: 5,234,142

[45] Date of Patent: Aug. 10, 1993

[54] PROTECTIVE FINGER SOCKET

[76] Inventors: Jason P. Loewen; Gary G. Loewen, both of 410 Michelle Creek Road, Sparwood, British Columbia, Canada V0B 2G0

[21] Appl. No.: 952,316

[22] Filed: Sep. 28, 1992

[51] Int. Cl.[5] ..... D05B 91/04; A41D 13/00; B26B 27/00

[52] U.S. Cl. ..... 223/101; 2/21; 30/298

[58] Field of Search ..... 30/298, 296.1; 223/101, 223/99; 2/21; 224/232; 7/121

[56] References Cited

U.S. PATENT DOCUMENTS

| | | | |
|---|---|---|---|
| 222,572 | 12/1879 | Chipley | 223/101 |
| 1,547,863 | 7/1925 | Dulin | 30/298 |
| 1,758,363 | 5/1930 | Grantham | 30/298 X |
| 2,151,846 | 3/1939 | Greneker | 30/298 |
| 2,735,127 | 2/1956 | Parsons | 2/21 X |
| 3,529,352 | 9/1970 | Pantages | 30/298 |
| 4,102,479 | 7/1978 | Braley | 223/101 |
| 4,966,174 | 10/1990 | Stanczak | 2/21 X |

*Primary Examiner*—Clifford D. Crowder
*Assistant Examiner*—Bibhu Mohanty
*Attorney, Agent, or Firm*—Leon Gilden

[57] ABSTRACT

A finger socket structure is arranged to afford protection to an individual's finger during various procedures. The invention includes a resilient socket structure having an entrance opening directed into a polymeric foam-lined cavity, wherein a nose portion of the socket includes a slot for receiving and positioning a knife blade therethrough. Side wall protective plates of a greater hardness than the socket shell is provided to afford lateral protection to the finger, with a groove directed through a bottom wall of the finger adjacent the entrance opening to secure a nail and the like for positioning the nail during a hammering procedure.

5 Claims, 4 Drawing Sheets

PROTECTIVE FINGER SOCKET

BACKGROUND OF THE INVENTION

1. Field of the Invention

The field of invention relates to finger protective devices, and more particularly pertains to a new and improved protective finger socket wherein the same affords protection to an individual's finger relative to abrasion, cuts, and the like.

2. Description of the Prior Art

Socket structure of various types have been utilized in the prior art and typically exemplified as thimble structure such as indicated in the U.S. Pat. Nos. 4,944,437; 4,643,341; 4,127,222; and 4,534,495.

The instant invention attempts to address deficiencies of such prior art by affording protection as well as providing for cutting and clamping structure not addressed in the prior art and in this respect, the present invention substantially fulfills this need.

SUMMARY OF THE INVENTION

In view of the foregoing disadvantages inherent in the known types of finger protective devices now present in the prior art, the present invention provides a protective finger socket wherein a polymeric shell includes a polymeric foam liner and spaced side wall protective strips to afford protection to an individual's finger during various working situations such as cutting, hammering, and the like. As such, the general purpose of the present invention, which will be described subsequently in greater detail, is to provide a new and improved protective finger socket which has all the advantages of the prior art thimble apparatus and none of the disadvantages.

To attain this, the present invention provides a finger socket structure arranged to afford protection to an individual's finger during various procedures. The invention includes a resilient socket structure having an entrance opening directed into a polymeric foam-lined cavity, wherein a nose portion of the socket includes a slot for receiving and positioning a knife blade therethrough. Side wall protective plates of a greater hardness than the socket shell is provided to afford lateral protection to the finger, with a groove directed through a bottom wall of the finger adjacent the entrance opening to secure a nail and the like for positioning the nail during a hammering procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved protective finger socket which has all the advantages of the prior art thimble apparatus and none of the disadvantages.

It is another object of the present invention to provide a new and improved protective finger socket which may be easily and efficiently manufactured and marketed.

It is a further object of the present invention to provide a new and improved protective finger socket which is of a durable and reliable construction.

An even further object of the present invention is to provide a new and improved protective finger socket which is susceptible of a low cost of manufacture with regard to both materials and labor, and which accordingly is then susceptible of low prices of sale to the consuming public, thereby making such protective finger sockets economically available to the buying public.

Still yet another object of the present invention is to provide a new and improved protective finger socket which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
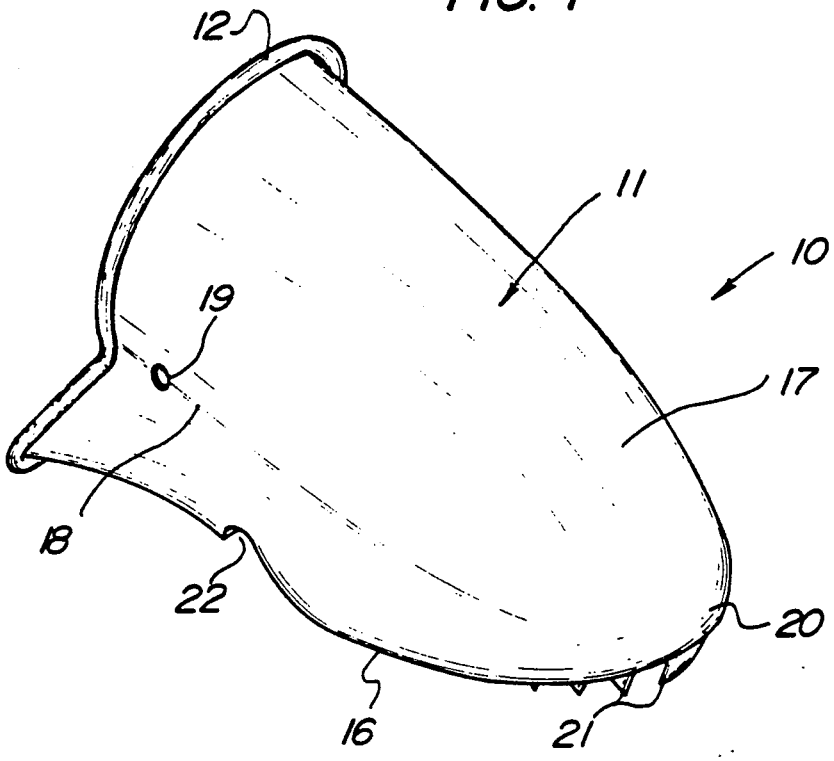
FIG. 1 is an isometric illustration of the instant invention.
Figure 2:
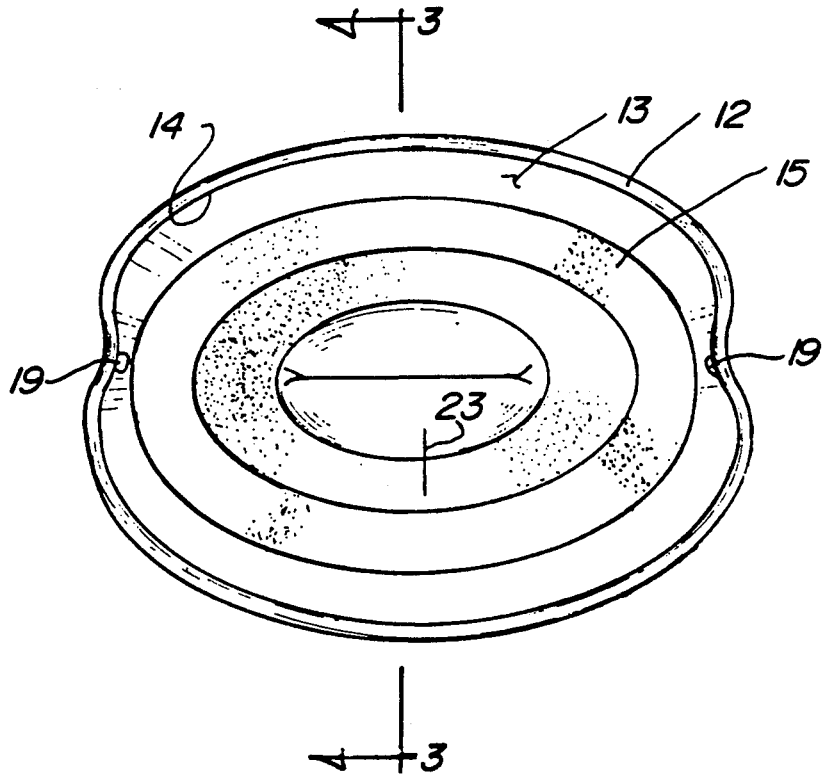
FIG. 2 is an orthographic end view of the invention.
Figure 3:
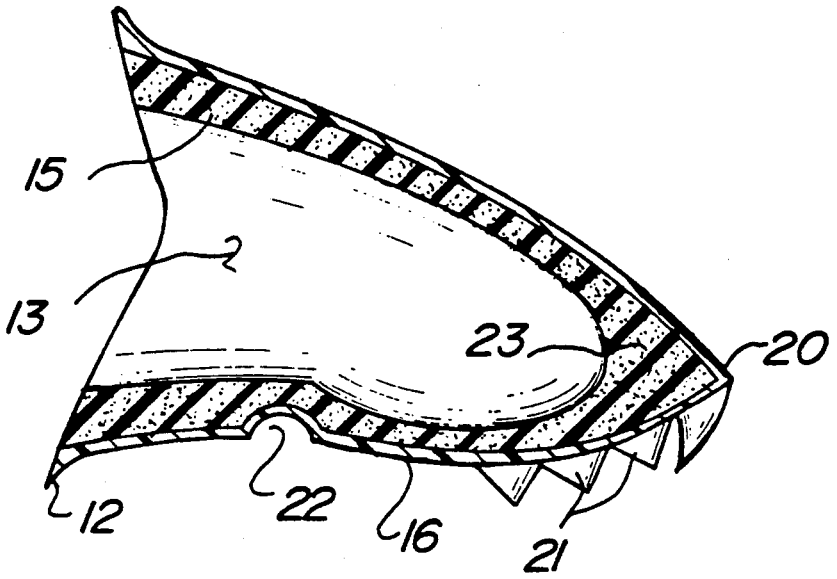
FIG. 3 is an orthographic view, taken along the lines 3—3 of FIG. 1 in the direction indicated by the arrows.
Figure 4:
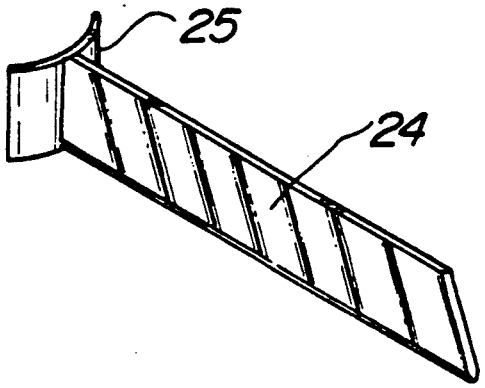
FIG. 4 is an isometric illustration of the knife blade structure utilized by the invention.
Figure 6:
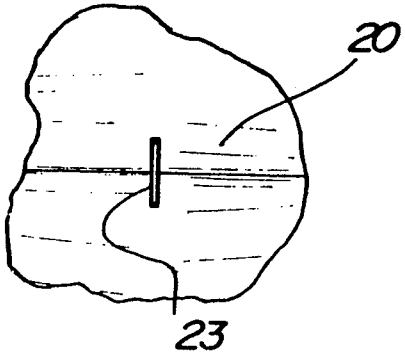
FIG. 6 is an orthographic view, taken along the lines 6—6 of FIG. 5 in the direction indicated by the arrows.
Figure 7:
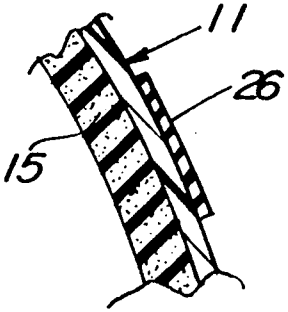
FIG. 7 is an orthographic view, taken along the lines 7—7 of FIG. 5 in the direction indicated by the arrows.
Figure 5:
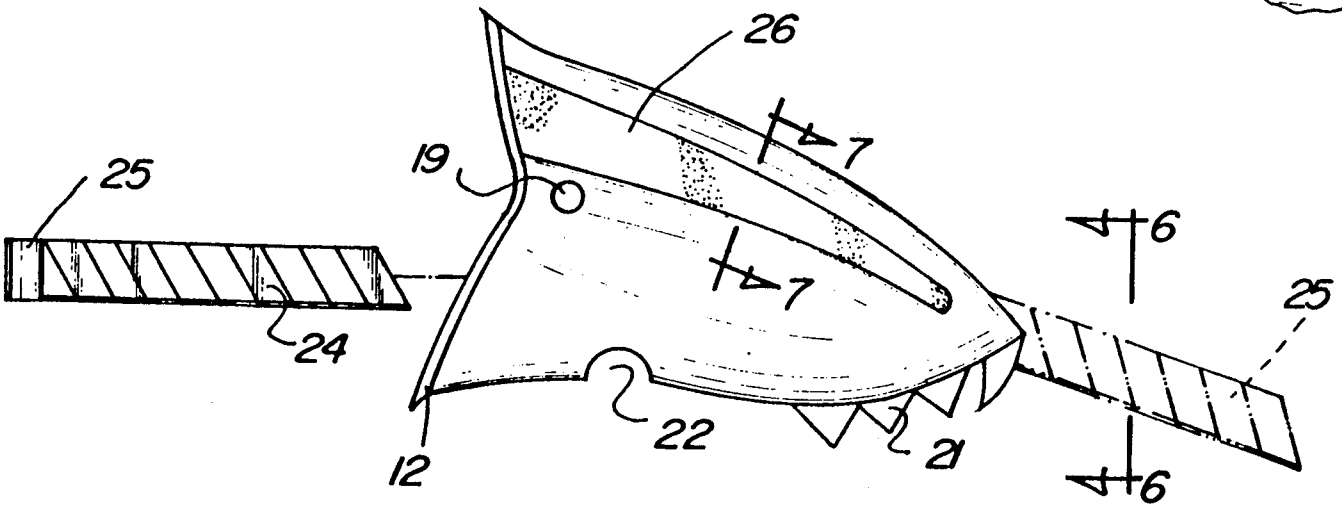
FIG. 5 is an orthographic side view of the knife blade structure in cooperation with the socket of the invention.

With reference now to the drawings, and in particular to FIGS. 1 to 9 thereof, a new and improved protective finger socket embodying the principles and concepts of the present invention and generally designated by the reference numeral 10 will be described.

More specifically, the protective finger socket 10 of the instant invention essentially comprises a flexible socket shell 11 having an entrance opening 14 at a first end thereof spaced from a socket nose 20 in a longitudinally aligned relationship. A flexible entrance rib 12 is arranged in surrounding relationship relative to the entrance opening to afford semi-rigidity and maintaining the entrance opening in a non-collapsed orientation to permit ease of entrance of an individual's finger into the socket shell 11. A polymeric foam liner 15 is directed coextensively within the socket cavity 13 of the socket shell 11, with the socket shell 11 having a bottom surface 16, a top surface 17, and side wall surfaces 18. Coaxially aligned apertures 19 are directed one in each of the side wall surfaces 18 through-extending the shell structure in adjacency to the rib 12 to receive a U-shaped extension shield 27, to be discussed in more detail below.

The bottom surface 16 includes a matrix of polymeric teeth members 21 positioned in adjacency relative to the nose 20 to enhance gripping of various objects to be utilized in a working procedure, such as hammering and the like, and to this end, a nail receiving groove 12 to receive a nail end (see FIG. 9) is directed in a parallel relationship relative to the entrance opening 14. A knife receiving slot 23 is directed through the nose 20 orthogonally oriented relative to the groove 22. The slot 23 is arranged to receive a knife blade 24 that has an arcuate knife blade hilt 25. The arcuate knife blade hilt 25 includes a concave surface in confrontation to the socket cavity 13 to receive an individual's finger to permit ease of positioning the knife 24 to assist in a severing procedure as required by use of the organization.

Flexible side wall shields 26 are positioned on the side wall surfaces 18 extending from the entrance rib 12 towards the nose 20 in a spaced relationship relative to the nose 20. The shields 26 are noted to be of a first hardness greater than the second hardness of the shell 11, that in turn is greater than a third hardness of the foam liner 15 to afford protection to an individual's finger within the shield structure.

Figure 9:
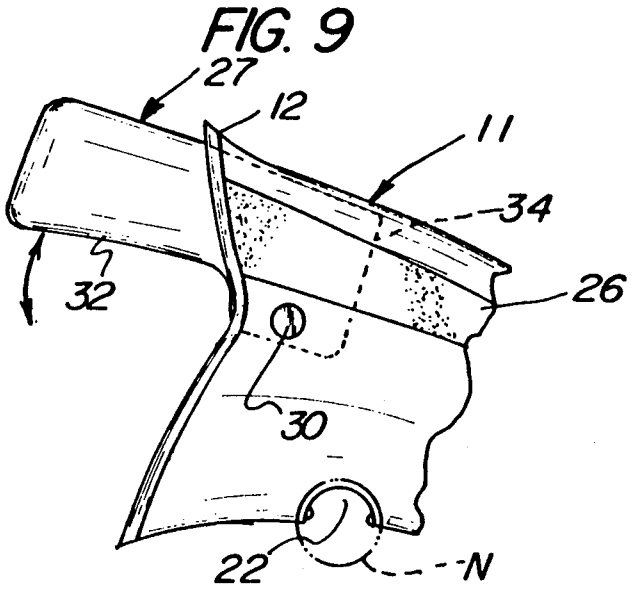
FIG. 9 is an orthographic side view of the extension shield mounted relative to the finger socket structure of the invention.
Figure 8:
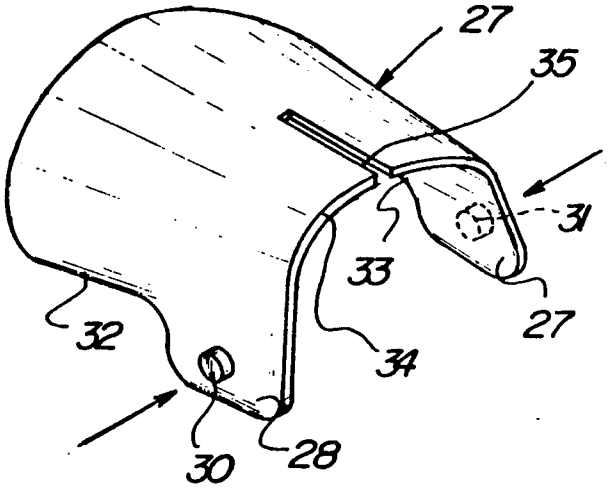
FIG. 8 is an isometric illustration of an extension shield utilized by the invention.

The U-shaped extension shield 27 is formed with a first and second ear flange 28 and 29 extending below the respective first and second side edges 32 and 33 respectively at the side edges intersection with the forward edge 34. Each of the first and second ear flange 28 and 29 includes a respective first and second cylindrical registration boss 30 and 31, with each boss received within one of the apertures 19 to position the shield, in a manner as indicated in FIG. 9, having the shield extending beyond and rearwardly of the rib 12 extending from the top surface 17, with the first and second side edges 32 and 33 arranged in a substantially coextensive relationship relative to lowermost edges of the side wall shields 26. An extension shield slot 35 is directed through the shield medially thereof in communication with the forward edge 34 to enhance flexure of the extension shield in its mounting within the socket shell 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letters Patent of the United States is as follows:

1. A protective finger socket, comprising, a flexible resilient socket shell, the socket shell having an entrance opening spaced from a nose in a longitudinally aligned relationship, with the entrance opening including a resilient entrance rib extending coextensively in adjacency to the entrance opening to maintain the entrance opening in an opened configuration, and wherein the shell includes a socket cavity, and the socket cavity includes a polymeric foam liner coextensive with the socket cavity, and the socket shell includes a socket bottom surface, a socket top surface, and spaced side wall surfaces, and the side wall surfaces each include an aperture, and each aperture is arranged in a coaxially aligned relationship relative to one another, and a U-shaped extension shield means arranged for mounting within the socket cavity extending from the socket cavity from the socket top surface, and the shield means including spaced bosses, with one of said bosses arranged for reception within one of said apertures.

2. A finger socket as set forth in claim 1 wherein the socket bottom surface includes a groove for permitting securement of a nail member within the groove, and the groove is arranged in a parallel spaced relationship relative to the entrance opening.

3. A finger socket as set forth in claim 2 including a knife receiving slot directed through the nose, the slot oriented orthogonally relative to the groove, and a knife blade slidably directed through the slot, and the knife blade having an arcuate hilt, and the arcuate hilt having a concave surface arranged in confrontation to the socket cavity to permit a finger to position the knife blade within the socket cavity.

4. A finger socket as set forth in claim 3 wherein each of the socket side wall surfaces includes a flexible side wall shield extending orthogonally relative to the entrance rib towards the nose in a spaced relationship relative to the nose, and each shield is of a first hardness and the socket shell is of a second hardness less than the first hardness, and the foam liner is of a third hardness less than the second hardness.

5. A finger socket as set forth in claim 3 wherein the shield means includes a U-shaped extension shield having a first side edge and a second side edge and a forward edge, wherein a shield slot is orthogonally oriented relative to the forward edge oriented medially between the first side edge and the second side edge to accommodate flexure of the extension shield.

* * * * *